US011167901B2

(12) United States Patent
Syvänne et al.

(10) Patent No.: US 11,167,901 B2
(45) Date of Patent: Nov. 9, 2021

(54) FLEXIBLE RESEALABLE PACKAGES

(71) Applicant: Bemis Company, Inc., Neenah, WI (US)

(72) Inventors: Ossi Ilari Syvänne, Hämeenlinna (FI); Kalle Ilmari Nättinen, Tampere (FI)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 16/619,681

(22) PCT Filed: Jun. 5, 2017

(86) PCT No.: PCT/US2017/035909
§ 371 (c)(1),
(2) Date: Dec. 5, 2019

(87) PCT Pub. No.: WO2018/226202
PCT Pub. Date: Dec. 13, 2018

(65) Prior Publication Data

US 2020/0140173 A1 May 7, 2020

(51) Int. Cl.
*B65D 75/58* (2006.01)
*B65D 77/26* (2006.01)

(52) U.S. Cl.
CPC ..... *B65D 75/5833* (2013.01); *B65D 75/5855* (2013.01); *B65D 77/26* (2013.01); *B65D 2575/586* (2013.01)

(58) Field of Classification Search
CPC ..... B65D 75/5833; B65D 75/5855; B65D 77/26; B65D 75/586; B65D 2575/586
USPC ..... 383/203, 204, 210–211
See application file for complete search history.

(56) References Cited

U.S. PATENT DOCUMENTS

| | | | | |
|---|---|---|---|---|
| 4,260,061 | A | 4/1981 | Jacobs | |
| 4,785,940 | A | 11/1988 | Wilson | |
| 6,461,044 | B1 * | 10/2002 | Anderson | B65D 33/20 383/204 |
| 7,927,679 | B2 | 4/2011 | Cruz et al. | |
| 8,231,024 | B2 | 7/2012 | Sanfilippo et al. | |
| 8,622,618 | B2 | 1/2014 | Moehlenbrock | |
| 8,979,370 | B2 * | 3/2015 | Moehlenbrock | B65D 75/5855 383/109 |
| 9,656,783 | B2 | 5/2017 | Lyzenga et al. | |
| 2003/0118254 | A1 * | 6/2003 | Razeti | B65D 75/5816 383/204 |

(Continued)

FOREIGN PATENT DOCUMENTS

| | | | |
|---|---|---|---|
| DE | 102009046507 A1 * | 5/2011 | B65D 75/5833 |
| EP | 2716566 A1 | 4/2014 | |

(Continued)

OTHER PUBLICATIONS

Machine translation of JP-2006199356-A.*

*Primary Examiner* — Jes F Pascua

(57) ABSTRACT

Resealable packages having a pressure sensitive adhesive (PSA) layer that is fully integrated into the packaging film and a removable portion easily accessed by a peel tab at the edge of the package, adjacent to a score. Removal of a portion of the package exposes the pressure sensitive adhesive layer and allows for access to the product in the package interior. The package is easily resealed by folding the exposed pressure sensitive adhesive layer to adhere to the outer surface of the package.

18 Claims, 7 Drawing Sheets

(56) References Cited

U.S. PATENT DOCUMENTS

| | | | | |
|---|---|---|---|---|
| 2004/0264816 | A1 | 12/2004 | Carter | |
| 2010/0247003 | A1* | 9/2010 | Huffer | B65D 75/5855 383/207 |
| 2011/0038569 | A1 | 2/2011 | Huffer et al. | |
| 2013/0087479 | A1 | 4/2013 | Bloch et al. | |
| 2013/0121623 | A1 | 5/2013 | Lyzenga et al. | |
| 2014/0185965 | A1 | 7/2014 | Lyzenga | |
| 2016/0137377 | A1* | 5/2016 | Tracy | B65D 75/008 222/566 |
| 2017/0327289 | A1* | 11/2017 | Huffer | B65D 75/30 |

FOREIGN PATENT DOCUMENTS

| | | | | |
|---|---|---|---|---|
| EP | 3470344 | A1 * | 4/2019 | B65D 33/20 |
| JP | 2006199343 | A | 8/2006 | |
| JP | 2006199356 | A * | 8/2006 | |
| JP | 2012081967 | A | 4/2012 | |
| WO | 15178882 | A1 | 11/2015 | |
| WO | WO-2016120273 | A1 * | 8/2016 | B65D 75/008 |

* cited by examiner

FLEXIBLE RESEALABLE PACKAGES

TECHNICAL FIELD

The present disclosure is related to the field of flexible peelable and resealable packages.

BACKGROUND

One typically important function of packaging is to securely contain the packaged contents through expected environmental conditions of the products distribution and use. Additionally, certain packaging also has functionality to easily open, allowing the user to access the contents, and securely reseal again, protecting the product within. This functionality is often desired for products such as fresh food, frozen or pre-cooked food, pharmaceuticals, or other products that are portioned during use.

Easy opening and resealing of a package has been achieved in a number of package designs and formats. For rigid packaging, lids can snap or twist on and off. Flexible packaging typically employs mechanically engaging zippers that are adhered to the package material. Additional components are added to the package, requiring complex operations for securing and additional expense. As the complexity of these package designs increases, the risk of faulty manufacturing increases as well, resulting in leaking packages or packages that do not function properly, and leading to consumer frustration.

Flexible packaging has also employed pressure sensitive adhesive to provide repeated opening and resealing functionality. The pressure sensitive adhesive can be incorporated into the packaging components in various ways, including labels, reseal strips or as part of the existing packaging material. Inclusion of the reseal functionality into the existing packaging material can simplify the manufacturing processes and increase reliability of the closure system. However, these packages can be difficult to use because of the package design. The exposed pressure sensitive adhesive can be a nuisance while the consumer is reaching into the package or dispensing the product. Additionally, the packages can be difficult to open or have less than desirable resealability.

SUMMARY

A peelable and resealable package has been designed which has improved functionality during opening, use and reclosing. Opening improvements may be attributed to the location of a peel tab with respect to the edge of the package and the score defining a removable portion of the package. The use of the package is improved due to the removable portion of the packaging providing a large access area. Reseal improvements may be attributed to a reseal region which is large in size and shape. The combination of these improvements are designed together and implemented with a simplified manufacturing process.

One embodiment of the resealable packages has a closed state, an open state and a resealed state. The packages have a first panel and second panel, each with an interior surface, an exterior surface. The second panel is positioned generally opposite the first panel and a bond is formed between the interior surface of the first panel and the interior surface of the second panel. The bond extends around at least a portion of a periphery of the first and second panels. At least one of the first or second panel has a pressure sensitive adhesive. A score in the first panel extends from the edge of the first panel and through the bond, the defining a removable portion of the first panel. The removable portion of the first panel has an unsealed region located between the bond and the edge of the first panel, adjacent to the score. The packaged are configured to transition from the closed state to the open state by fracturing the first panel at the score, peeling the removable portion of the first panel away from the second panel and exposing the pressure sensitive adhesive in the area of the bond. The packages are configured to transition from the open state to the resealed state by folding the second panel to adhere the exposed pressure sensitive adhesive to the exterior surface of the first panel.

Some embodiments of the resealable packages transition from the closed state to the open state by complete separation of the removable portion of the first panel from the package. Further, when in the open state the area of exposed pressure sensitive adhesive may be irregular.

Embodiments of the resealable packages may have the pressure sensitive adhesive at least coextensive with the bond areas in the removable portion of the first panel. Alternatively, the coextruded pressure sensitive adhesive may be substantially coextensive with either the first or second panel. The pressure sensitive adhesive may be coextruded with at least one other layer of either the first or second panel.

Some embodiments of the resealable packages include a score in the second panel at least partially located within the bond such that transitioning from the closed state to the open state, the score in the second panel is fractured and a portion of the second panel is also removed. The score in the second panel may have an irregular shape.

Another embodiment of the resealable packages has a first and second panel, both having an interior and exterior surface. The second panel is generally opposite the first panel. A bond formed between the interior surface of the first panel and the interior surface of the second panel extends around at least a portion of a periphery of the panels. A score in the first panel, extending from an edge of the first panel, through the bond, defines a removable portion of the first panel. The packages also have a pressure sensitive adhesive located as an inner layer of either the first or second panel and an unsealed region located on the removable portion of the first panel, adjacent to the score, and between the bond and the edge of the first panel. The unsealed region could be sized to be grasped with a finger.

In some embodiments of the resealable packages the score intersects the edge of the first panel and the bond in two different locations. The first and second panels could be continuous with each other. In some embodiments the package is hermetic and the panels may include an oxygen barrier layer. The bonds may be heat seals.

In yet further embodiments of the resealable packages the second panel also includes a score and a removable portion. The removable portion of the second panel can be partially coextensive with and bonded to the removable portion of the first panel. The removable portion of the second panel can be partially defined by the second panel score.

Additional embodiments of the resealable packages have a closed state, an open state, and a resealed state. The resealable packages have a first panel having an interior surface and an exterior surface, and a second panel positioned generally opposite the first panel also having an interior surface and an exterior surface. At least one of the first or second panels is formed from a coextruded multilayer film comprising a layer of pressure sensitive adhesive that is substantially coextensive with either panel. A bond fixes the first panel to the second panel. In the closed state, the first panel has a score intersecting the bond at two different locations thereof and a removable portion defined by the area between the score and the edges of the package. The removable portion comprises a peel tab constructed from aligned and unsealed regions of the first and second panels. The removable portion is configured to separate from the package when transitioning from the closed state to the open state. In the open state, the second panel comprises a reseal flap having the pressure sensitive adhesive of the multilayer film on the interior surface of the second panel that is exposed after the removable portion of the first panel is removed from the package when transitioning from the closed state to the open state. In the resealed state, the reseal flap is folded over and bonded onto the exterior surface of the first panel.

In some embodiments of the resealable packages, the first panel, the second panel and the bond define a product containment space which may also include a tray and/or a portionable product.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

A peelable and resealable package has been designed which has improved functionality. The location of a peel tab with respect to the edge of the package and the score defining a removable portion of the package improve the consistency of the opening functionality. The removable portion of the packaging provides a large access area allowing for easy access to the contents of the package. The resealing region can be large in size and shape improving the reclose functionality of the packaging.

Referring generally to the FIGURES, disclosed herein are flexible packages that are resealable, configured to transition from a closed position to an open position, and subsequently to a resealed position. The packages can also be repeatedly transitioned between the open position and the resealed position.

The configuration of the packages can be such that transitioning a package from one position to another is intuitive for a consumer. Significantly, in a single step a consumer can both open the package and expose a pressure sensitive adhesive that provides for the package to be transitioned to the resealed position.

The embodiments and description provided herein are provided such that a clear understanding of the package design and implementation thereof is possible. The figures and description indicate a variety of different aspects, but should not be construed to limit the possible embodiments of the invention.

Figure 2:
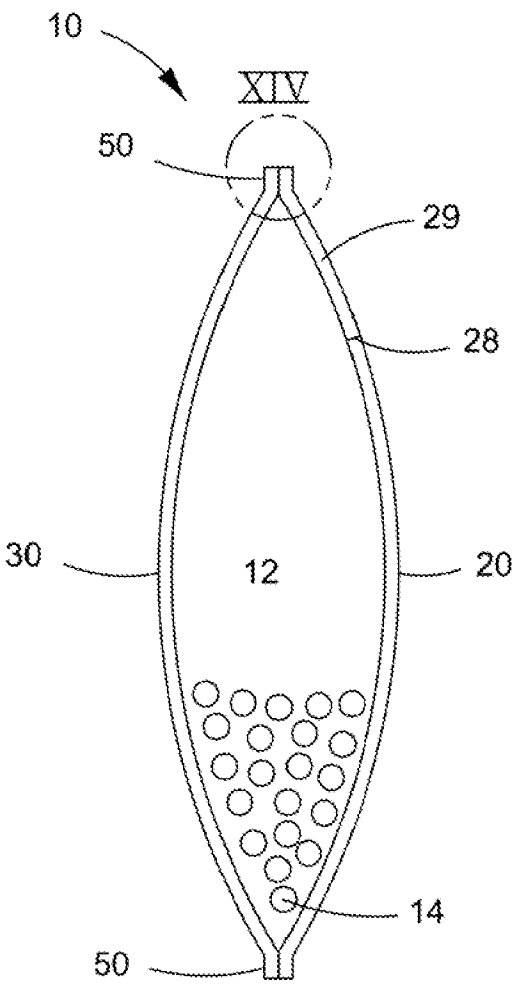
FIG. 2 is a cross-sectional view of the package in FIG. 1.
Figure 1:
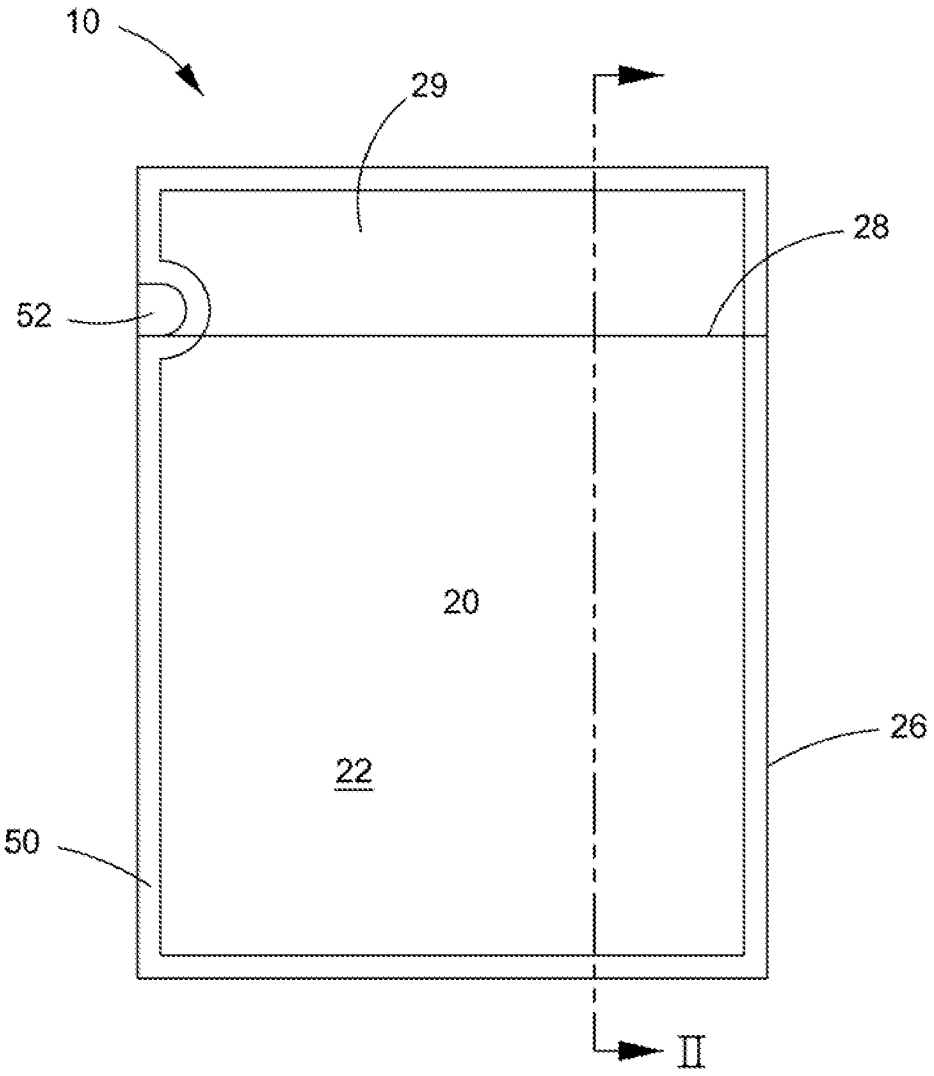
FIG. 1 is a plan view of an exemplary flexible package in the closed state.

FIG. 1 (plan view) and FIG. 2 (cross-section of FIG. 1) show one embodiment of the resealable flexible packages (10) in the closed state (i.e. prior to being opened for the first time). The resealable package is constructed by a first panel (20) and a second panel (30), both consisting of a flexible packaging material. The panels are bonded together around the periphery of the package (50) creating a product containment space (12) therein. The bond can be configured such that an unsealed region (52) is located between the bond (50) and the edge of the first panel (26). Additionally, the unsealed region (52) is adjacent to a score in the first panel (28). As used herein, a "score" is a weakened area in one or more layers of the panel, continuing in a linear or non-linear direction, in a continuous or non-continuous manner. The score in the first panel (28) begins at an edge of the first panel (26), continuing through the bond (50) and defines a removable portion of the first panel (29). FIG. 2 provides a cross-sectional view of the package in FIG. 1, depicting the second panel (30), the product containment space (12) and the product within the package (14) which are not shown in FIG. 1.

Packages of this type may be produced in many ways, especially those commonly known to those skilled in the art of commercial packaging processes. Packages can be made on form-fill-seal equipment utilizing two webs for the first and second panel. Alternatively, a single web of packaging film can be folded over to form both the first and second panel. The format of the packages can be any of those known to the industry including pouches, thermoformed trays with lidding or even those that include additional components such as stand-up pouches that require gusset panels.

Some embodiments of the packages may utilize heat seals to bond the panels. However, any means of bonding, attaching or connecting the panels that does not disrupt the opening and resealing functionality described herein may be used. Examples of alternative bonding techniques include ultrasonic sealing or adhesives. In addition, some edges of the package may be closed by other means, such as a fold in the panel, an additional gusset panel or an added fitment.

In all embodiments, there is an unsealed region between the bond securing the first and second panels and the edge of the panels in an area directly adjacent to the score in the first panel. As used herein, the "unsealed region" is an area where the interior surfaces of the first and second panel are aligned and adjacent to each other, but are not bonded. The unsealed region (52) adjacent to the score and between the bond and the edge of the first panel may be large enough to be grasped as a peel tab. The unsealed region (52) could be approximately sized to the tip of a finger. Sized as such, the unsealed region could act as a peel tab and be used to initiate tearing of the score and opening of the package by a manual process (i.e. by hand).

Typical flexible packaging has a peel tab located at the corner of the package geometry. Consumers separate the panels at the peel tab and peel open the bond between the panels. In the embodiments described herein, the unique position of the unsealed region (52) can assist the successful opening of the package. The unsealed area creates a peel tab from which the user can separate the panels and open the package. When the unsealed area is positioned adjacent to the score, which may or may not be near a corner of the package, fracture of the score in the first panel and subsequent opening of the package can be more consistently achieved.

The resealable packages described herein would be suitable for containing a large variety of products. As seen in FIG. 2, the product (14) can be safely stored within the product containment space (12). Products could be food, pharmaceutical, industrial, or anything else benefiting from containment. The disclosed packages are especially suitable for products that are portioned, i.e., where only a portion of the product is used at a time, and thus benefiting from the functionality of reseal. Additionally, the product containment space could also contain other objects such as a tray or scavenger sachet.

Opening the flexible packages disclosed herein involves grasping the front panel at the unsealed region (52) adjacent to the score of the first panel (28), fracturing the score and peeling open the bonds in the area of the removable portion of the first panel (29). The removable portion is not required for reseal; thus, a consumer can completely remove this portion and need not keep track of it to utilize the reseal functionality of the packages. The bonds in the area of the removable portion of the first panel (29) should be peelable to allow the user to manually open the package. The bonds in the remainder of the package may be either peelable or fusion seals. Peelable seals can be designed by material selection, film structure or a combination thereof. The term "peelable seals" is herein defined as any flexible packaging structure and/or material formulation that allows the bonds of the package to be peeled open using manual force.

Figure 4:
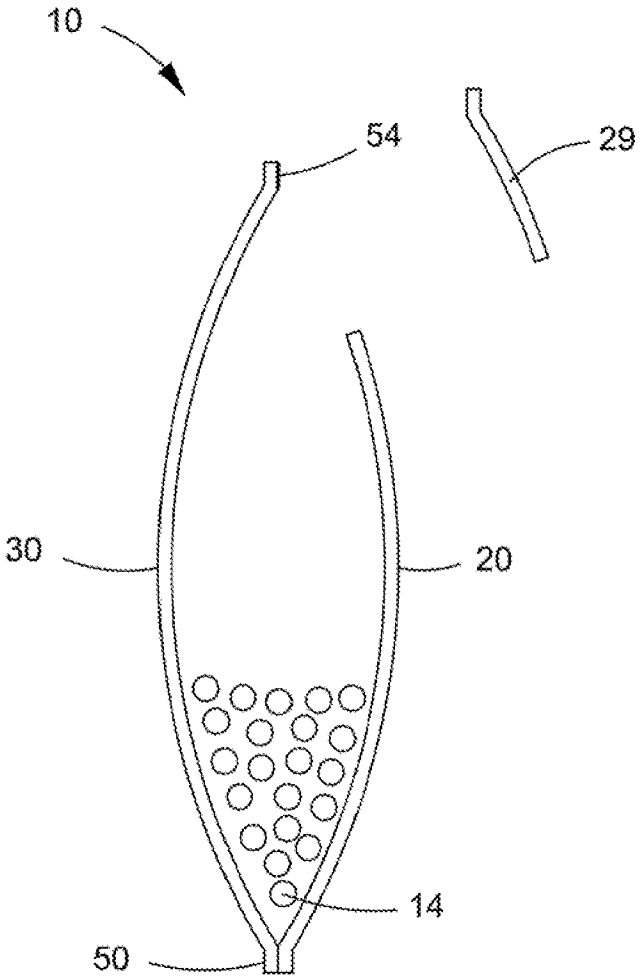
FIG. 4 is a cross-sectional view of the package in FIG. 3.
Figure 3:
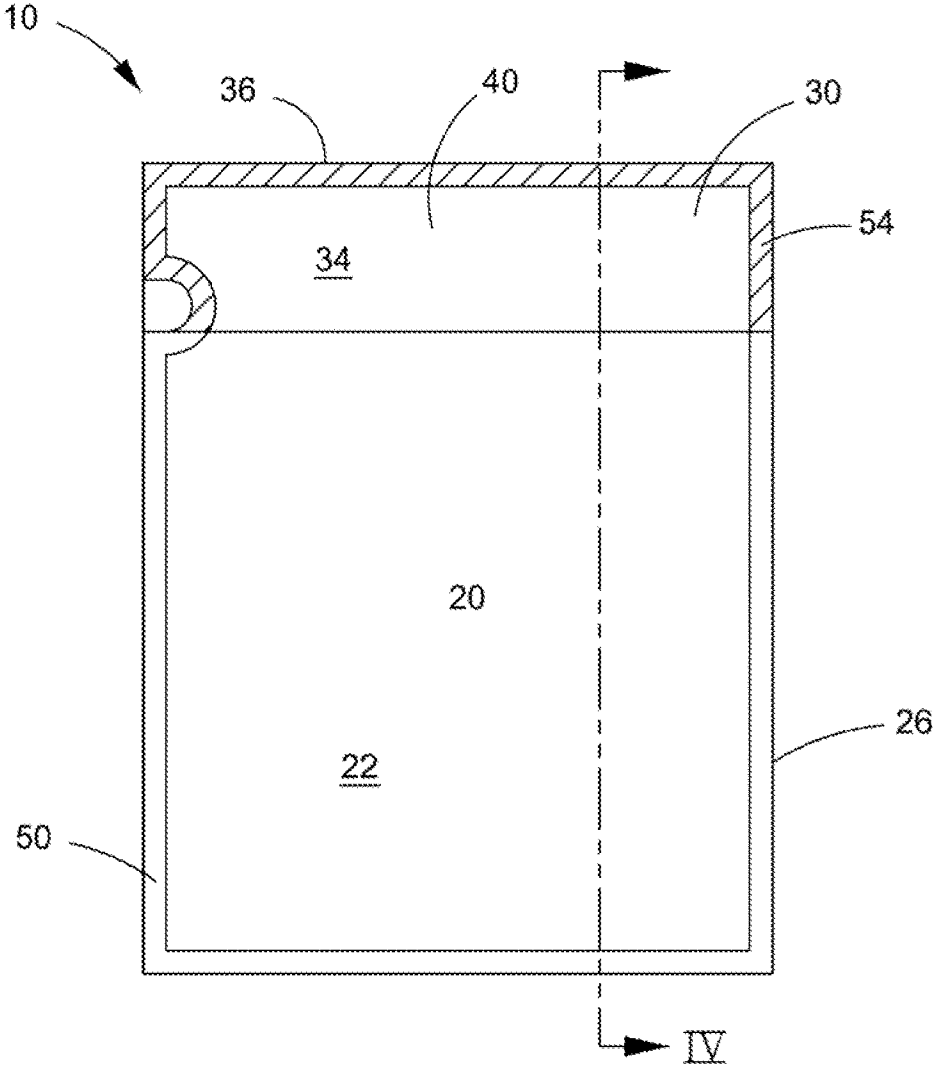
FIG. 3 is a plan view of an exemplary flexible package in the open state.

Peeling open the bonds results in exposing a pressure sensitive adhesive which is present in either the first or second panel. FIGS. 3 and 4 show the package in the open state, i.e., after complete separation of the removable portion of the first panel (29). As compared to the closed package in FIG. 1, the open package in FIG. 3 depicts the now exposed pressure sensitive adhesive region (54). The exposed pressure sensitive adhesive region (54) corresponds to the previously bonded, now peeled open, area between the removable portion of the first panel (29) and the second panel (30). The exposed pressure sensitive adhesive region (54) has any shape, likely an irregular shape (i.e. the shape of the area is not defined by any regular polygon). The contents of the package (14) can be accessed through the large opening created by removing a portion of the front panel.

For best results, the pressure sensitive adhesive that is exposed upon opening the package may be present in an inner layer of either the first or second panel. The term "inner layer" as used herein refers to a layer is that is not exposed to handling and the environment, i.e., is not on either the interior nor exterior surface of the panel. An inner layer may be fully or partially coextensive with the panel. Pressure sensitive adhesive that is present as an inner layer may be substantially coextensive with the panel. The pressure sensitive adhesive may be coextensive with greater than 90% of the panel. Films having an inner layer comprising a pressure sensitive adhesive that is subsequently exposed upon peeling open a bond are known in the packaging industry.

Figure 6:
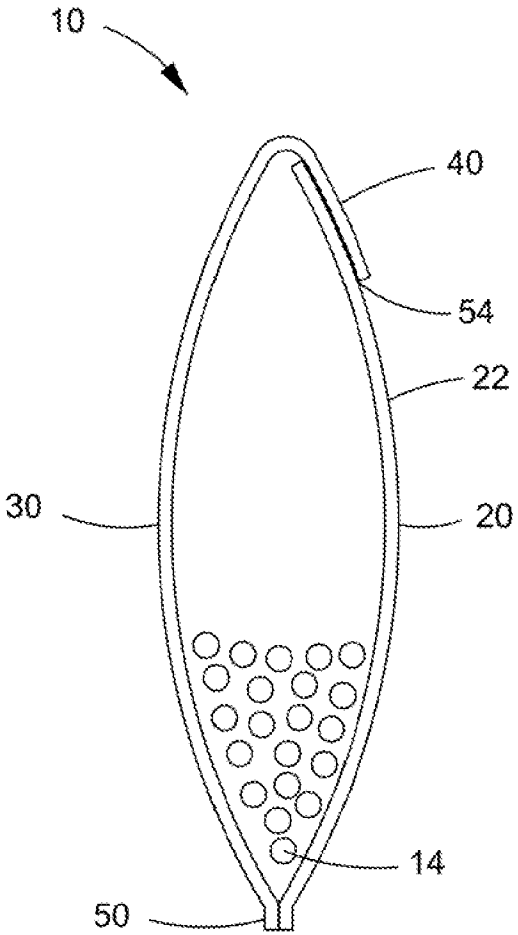
FIG. 6 is a cross-sectional view of the package in FIG. 5.
Figure 5:
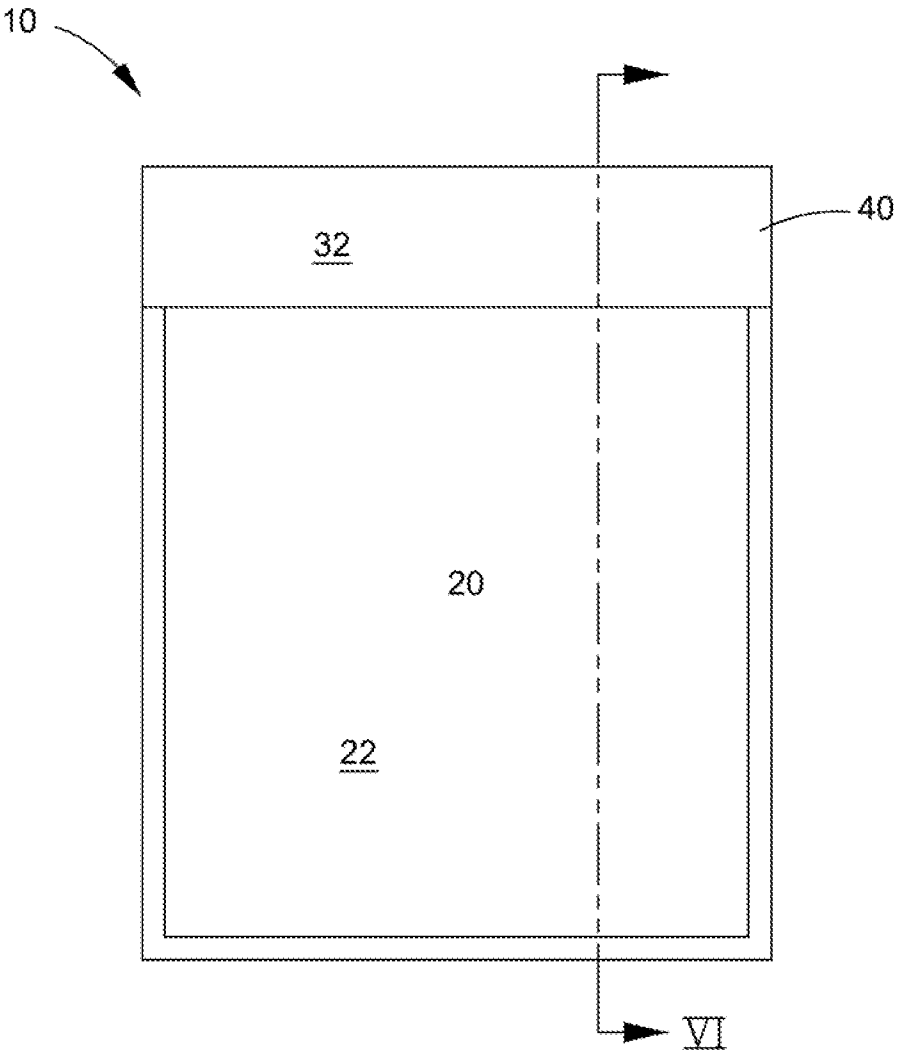
FIG. 5 is a plan view of an exemplary flexible package in the resealed state.

FIGS. 5 and 6 show the package in its resealed state, i.e. the package is closed such that the contents may be secured. The portion of the second panel that has the exposed pressure sensitive adhesive (54) now acts as a reseal flap (40). The reseal flap can be folded over the package opening and the exposed pressure sensitive adhesive region (54) can be adhered to the exterior surface of the first panel (22), securing the product within the package. Herein, the term "exterior surface" refers to the surface of the panel that faces the outside (non-product side) of the package to which it belongs. To reopen the package, the user can peel the reseal flap away from the exterior surface of the first panel, again gaining access to the contents of the package. In this manner, the packages can be opened and resealed several times, until the contents are exhausted. As mentioned previously, the removable portion is not required for reseal; thus, a consumer need not keep track of the removable portion to utilize the reseal functionality of the package. Further, there are no add-ons such as metal tin-ties, zippers, reseal strips or reseal labels required for resealing the package. As compared to previous package designs, the packages described herein have a simple and intuitive reclosing mechanism.

As compared to previous resealable packages, the embodiments shown in FIGS. 5 and 6 have a superior reseal state. The exposed pressure sensitive adhesive region corresponds to the previously bonded seal area and extends from the bottom edge of the reseal flap (the area adjacent to the remaining first panel) to the top of the package. When the reseal flap is folded over, the consumer can manually reseal the flap to the exterior surface of the front panel along the entire periphery of the reseal flap, including the sides. This will provide a secure seal and prevent the contents from exiting the package.

Additionally, the relatively large size and extended shape of the exposed pressure sensitive adhesive may be useful for secure reclosing of the package. As opposed to having a narrow seal area with which to reseal, the packages described herein allow the user to take advantage of all of the bond space in the area of the removable portion of the first panel. The bond area can be across the top and down the sides, or in any other pattern to create a reseal area. Reseal quality can be improved over previous resealable packages due to the relatively large dimensions of the reseal area. The width of the bonds could range from 3 to 50 mm and can have any type of contouring. Typically, the bonds are between 3 and 10 mm and more typically about 5 mm in width. The width of the bonds can vary from one area to another. The design of the bond dictates the size and shape of the exposed pressure sensitive area and should be optimized for reseal and opening performance.

Figure 8:
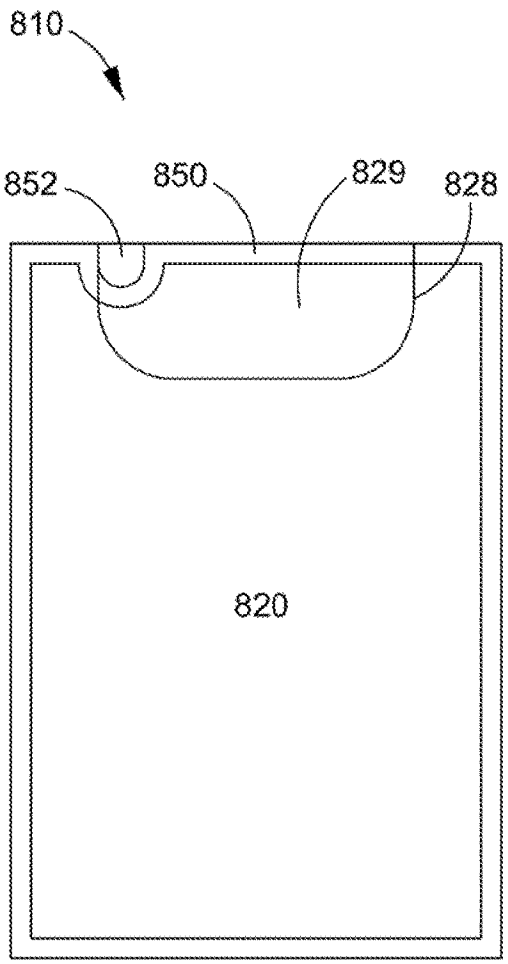
FIG. 8 is a plan view of another exemplary flexible package.
Figure 7:
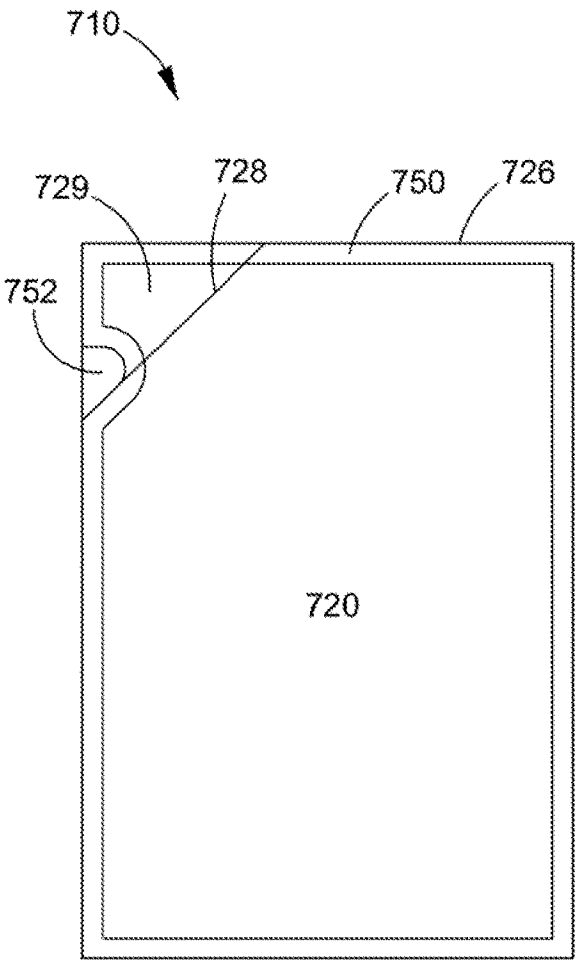
FIG. 7 is a plan view of another exemplary flexible package.
Figure 11:
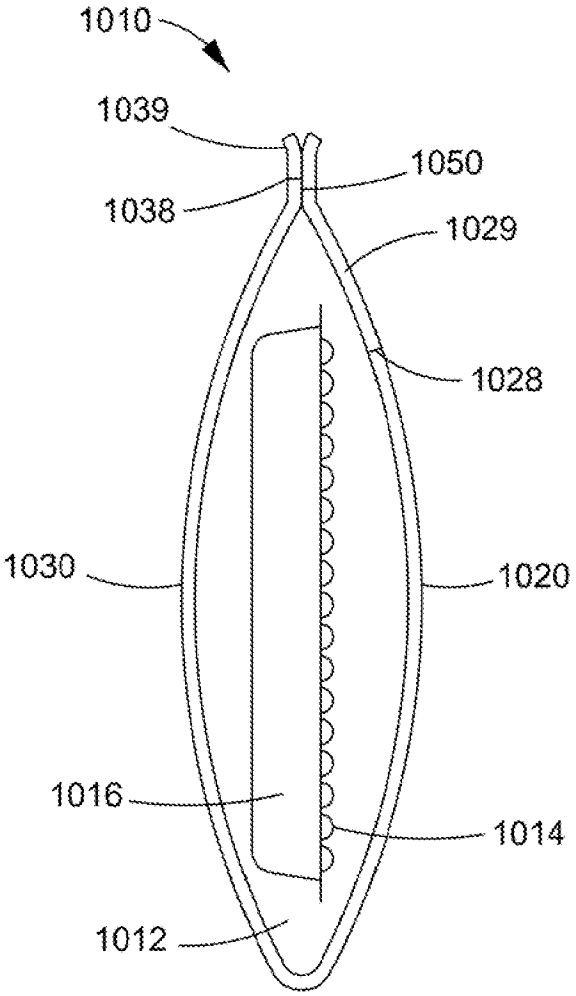
FIG. 11 is a cross-sectional view of the package in FIG. 10.

It has been envisioned that the removable portion of the first panel could have a wide variety of sizes and shapes. Examples of alternate embodiments are shown in FIGS. 7 and 8. The score in the first panel (728) of the resealable package (710) in FIG. 7 has endpoints that are on adjacent edges of the front panel, creating a removable portion of the first panel (729) that has a triangular shape. The resealable package (810) in FIG. 8 has a non-linear score in the first panel (828) and has endpoints at different locations on the same edge of the front panel, creating a removable portion of the first panel (829) that is narrower than the width of the package. In both packages (710 and 810), opening and reclosing of the package can happen in the same manner as previously described. The examples shown in these drawings are not meant to limit the possible embodiments of the flexible package, but rather are included to further define the disclosed concept. To further clarify, the score can be of any shape or design, including curved or angled lines. The score and removable portion design allow for customization of the opening size and shape, reclose area and overall product containment.

The score in the first panel (28, 728, 828) as depicted in the drawings looks continuous, beginning and ending on an edge of the front panel. However, the score could also be discontinuous and/or end in a position away from the edge of the package. Films of the first panel can be engineered by materials and/or manufacturing process such that they continue to tear between segments of a score or beyond the end of the score such that the removable portion of the first panel can be fully separated from the rest of the package. Additionally, a tear notch may be added to the edge of the first panel near the score such that initiation of the score fracture is easier.

Figure 9:
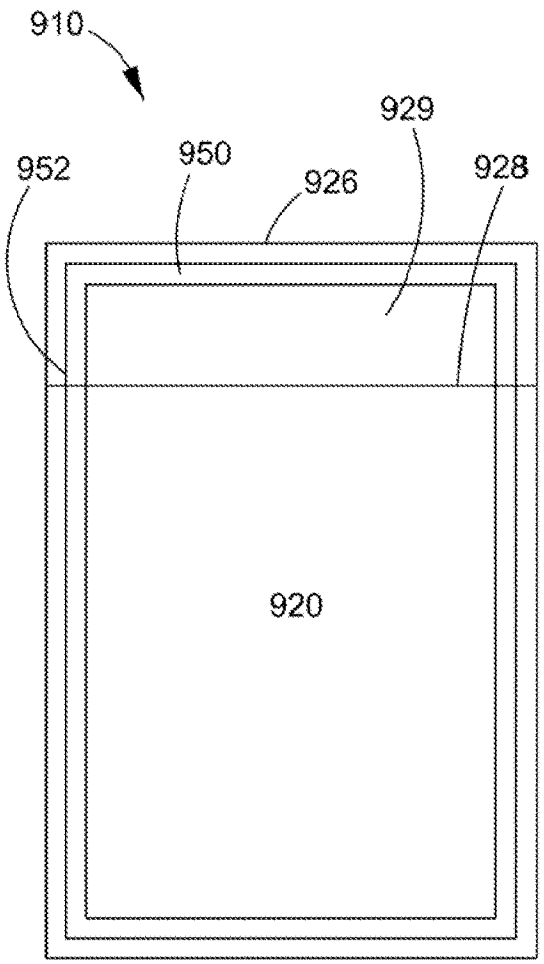
FIG. 9 is a plan view of another exemplary flexible package.

The bonds of the packages generally extend around the periphery of the package, leaving the center of the first and second panel unsealed, thus acting as the product containment space (12). As used herein, "periphery" is the space at or near the edges of the panels. The bonds may extend to the edge of the first panel (26, 726), as shown in FIGS. 1, 7 and 8. However, FIG. 9 shows an alternate embodiment of the resealable packages (910) in which the bond (950) extends around the periphery of the panels but is spaced away from the edge of the first panel (926). In this embodiment, the space between the bond (950) and the edge of the first panel (926) also forms the unsealed region (952) adjacent to the score in the first panel (920). Other embodiments may have the bond extend to the edge of the first panel in some areas and be spaced from the edge in other areas.

Another embodiment is shown as resealable packages (1010) in FIGS. 10 through 13. As in previous embodiments, first panel (1020) is secured to second panel (1030) by bond region (1050). The first panel has a score (1028) and a removable portion (1029). There is an unsealed region (1052) adjacent to the score in the first panel, between the bond and the edge of the first panel. Additionally, this embodiment includes a score in the second panel (1038). The score in the second panel is at least partially within the bond region (1050) and defines a removable portion of the second panel (1039). The removable portion of the second panel (1039) is partially coextensive with and bonded to the removable portion of the first panel (1029). The package can be opened by grasping the front panel at the unsealed region (1052) adjacent the score in the first panel (1028). Upon fracturing the score in the first panel and peeling the bonds of the removable portion of the first panel open, the score in the second panel (1038) is encountered and fractured, stopping the peel action. The removable portion of the second panel (1039) remains sealed to the removable portion of the first panel (1029) and the combination of the removable portions (1029 plus 1039) can be separated from the package completely, exposing the pressure sensitive adhesive (1054).

The shape and style options for the score in the second panel is the same as previously described for the score in the first panel. The score in the second panel (1038) can start at the edge of the second panel and extend into the bond region (1050). The score in the second panel can be continuous or intermittent in nature, can end within the second panel or extend to an edge of the second panel, and may be of various shapes, including curved and angled lines.

Figure 13:
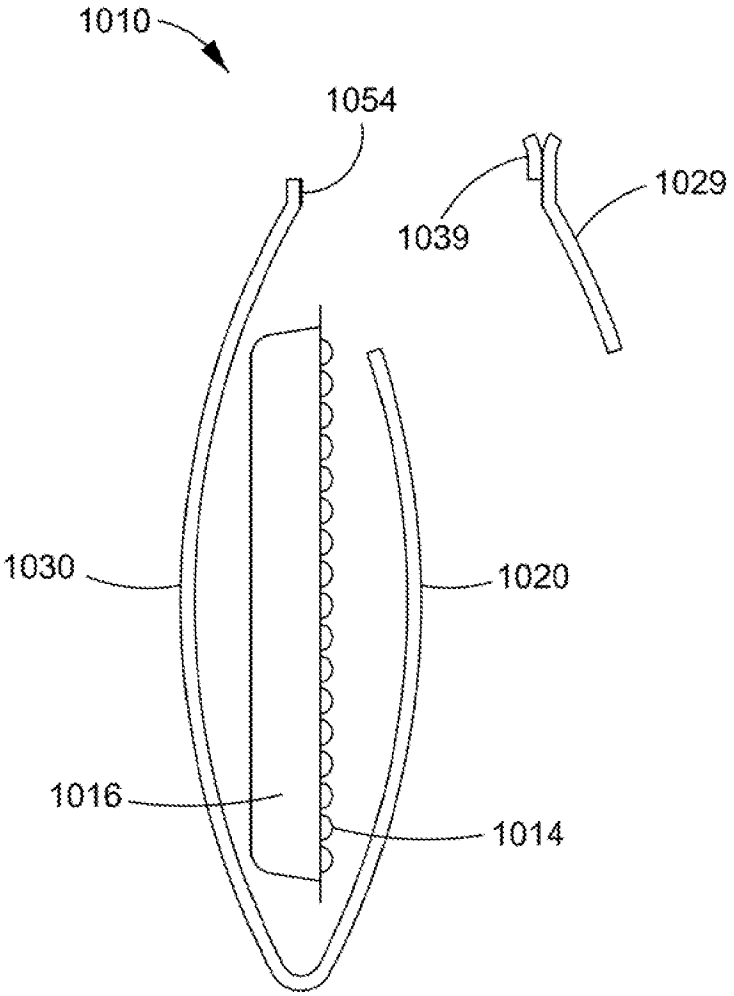
FIG. 13 is a cross-sectional view of the package in FIG. 12.
Figure 12:
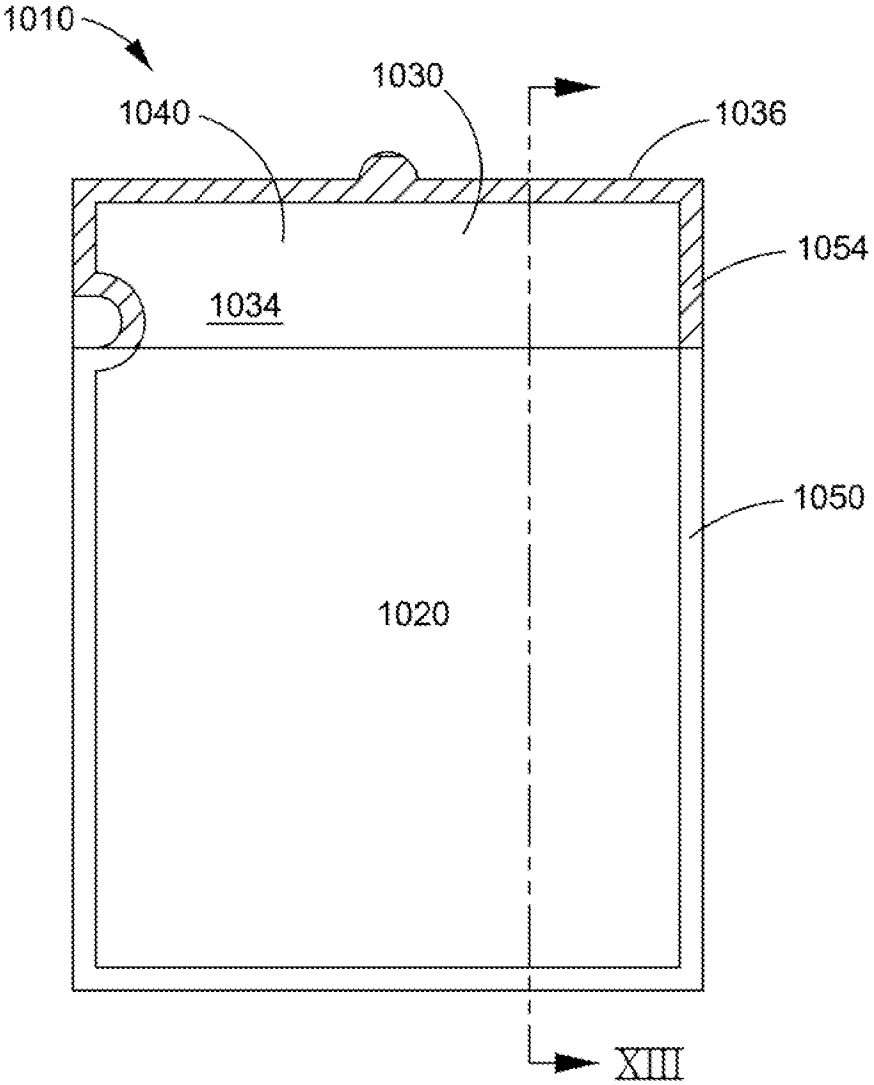
FIG. 12 is a plan view of another exemplary flexible package in the open state.

In the open position of resealable package (1010) shown in FIGS. 12 and 13, the reseal flap (1040) in the second panel (1030) is now partially defined by the previous locations of score in the first panel and the score in the second panel. The placement of the score in the second panel may be such that the reseal flap has an exposed pressure sensitive adhesive region (1054) generally around the periphery that is defined by the second panel edges (1036). The shape of the score in the second panel can create a unique shape for the reseal flap that corresponds with the package graphics. As in previously described embodiments, resealing the packages can be completed by folding the reseal flap (1040) over the package opening and against the exterior surface of the first panel.

Figure 10:
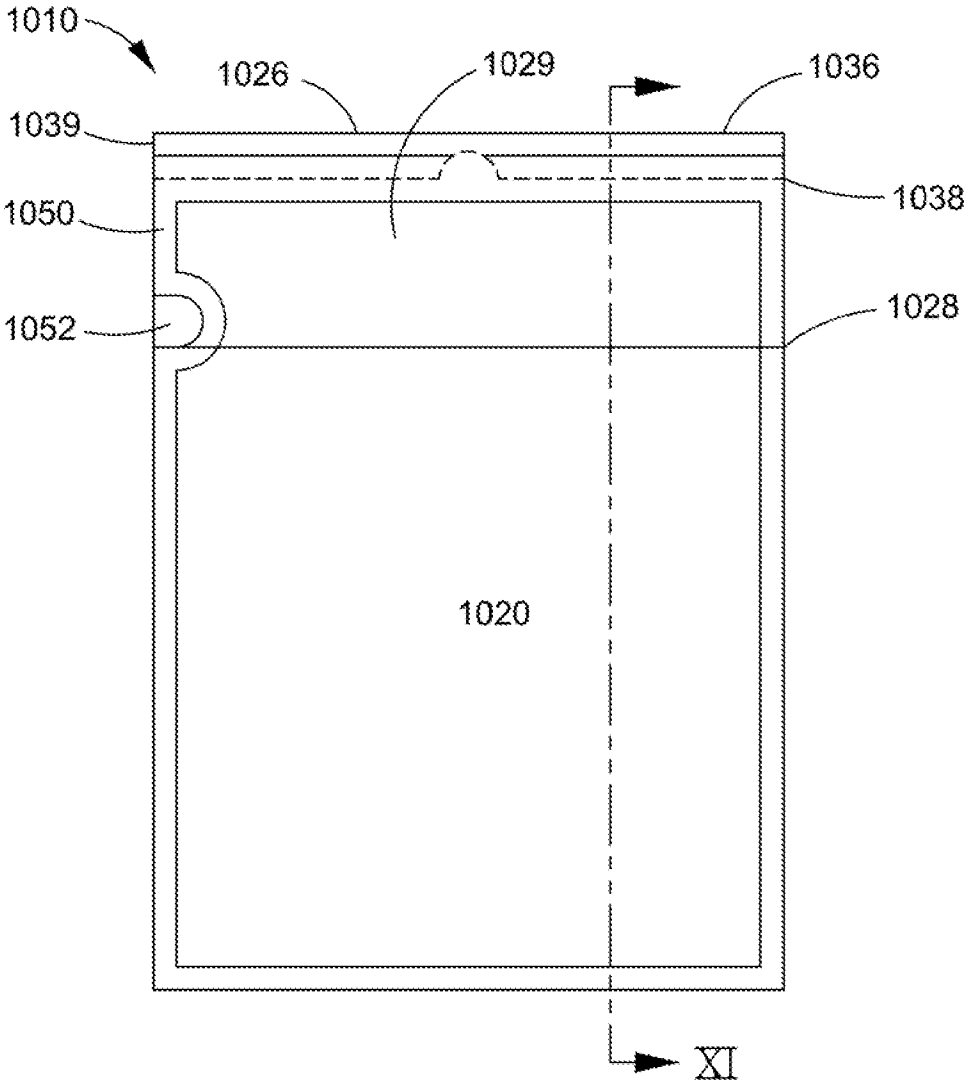
FIG. 10 is a plan view of another exemplary flexible package in the closed state.

Optionally, the score in the second panel can also be partially located in an unsealed area between the bond region and the edge of the second panel. This is shown in FIGS. 10 and 12, by a curved portion of the second panel score (1038) near the center of the package. The reseal flap (1040) now has a small section near the edge that does not have exposed pressure sensitive adhesive on the surface. When the reseal flap is pushed against the exterior surface of the first panel for reseal, this "non-adhesive" area can serve as a convenient place to grab to re-open the package.

Of further note of the embodiment shown in FIGS. 10-13 is the location of the bond region (1050). The bottom edge of the shown resealable package does not include a bond. In this case the first panel and the second panel are continuous with each other (i.e. the first and second panels are the same material folded over on itself) and the bottom edge is closed by a fold in the panel material. Although not shown, the packages could also be closed by an additional panel, such as a gusset inserted into one or more of the seal areas.

As described herein, the "panels" separate the product containment space and the product within the package from the environment. The flexible packages described herein may have panels which are monolayer, i.e. a single layer made of a singular or blend of materials, or multilayer films. The layers of the panels may be combined using any method known as typical film conversion techniques. Combination techniques include, but are not limited to, coextrusion, lamination, and coating techniques. The layers may be fully coextensive, extending over the same area, with the panel, or may be only partially coextensive. The panels can be of any thickness desired for the package design. Packaging that would be conducive to this package design could be from about 1 to about 10 mil in thickness. As described, the second panel must of a thickness and stiffness such that it can be folded over the first panel for resealing.

The panels of the flexible packages have seal strength, stability, opacity, heat resistance, oxygen and water vapor transmission properties, as well as other properties that allow them to protect the contents therein through the intended use of the package. Additionally, the panels may have other functionality and features, such as graphics, tactility, odor/gas absorption, thermoformability, clarity, etc.

To manufacture the resealable packages, the interior surfaces of the first and second panels are secured to each other, typically by a heat seal. As used herein, the term "interior surface" refers to the panel surface that is closest to the product containment space or packaged product. The interior surface of both panels should be designed for the purpose of securing. For example, the interior surface may consist of a material or a blend of materials that can be heat sealed. That is, the interior surface comprises a thermoplastic polymer or polymer mixture that softens when exposed to heat and returns to its original condition when cooled to room temperature. This surface allows two materials to be attached together when subjected to heat and pressure. The heat seal may continue around the periphery of the panels, such that the closed package is hermetic, i.e. the product inside the package is substantially protected from the exterior environment. Ideally, the panels are dimensionally stable such that they do not shrink when the heat seals are made or when elevated temperature is otherwise encountered.

According some embodiments, the interior layer of one or both of the panels comprises a heat sealable material. In general, a heat sealable interior layer may comprise any suitable thermoplastic material including, but not limited to, synthetic polymers such as polyesters, polyolefins, polystyrenes, and the like, or blends thereof. Exemplary polyolefins include polyethylene (PE) and polypropylene (PP). The interior surface of the first panel may be the same as or different than the interior surface of the second panel.

Alternatively, the interior surface may be treated or made of a specific material such that it can be bonded by an adhesive. In such an embodiment an adhesive is then deposited between the panels around the periphery of the packages producing a secure bond between the panels. The interior surface of the first panel may be the same as or different than the interior surface of the second panel.

Generally the exterior layer of the panels should consist of a material that can provide abuse resistance and protection of the other layers of the panel, as well as the contents of the package. According to some embodiments the exterior or outermost layer of the panels is an oriented film. Oriented films can provide beneficial tear properties (i.e., helping separation propagate along a desired path), particularly when used with certain types of scores. Exemplary oriented films include oriented polyethylene terephthalate and oriented polypropylene. According to other embodiments, the exterior film need not be oriented, but, rather, may comprise any material suitable for a given packaging application (e.g., a barrier film, polypropylene, paper, etc.).

The multilayer films may have one or more inner layers. An "inner layer", as used herein, refers to a layer is that is not exposed to handling and the environment. Inner layers may provide functionality as needed for particular applications. Inner layers may generally structure to allow for thermoforming of the panel, or may provide barrier protection and/or strength. Inner layers may provide general durability, puncture strength, resistance to curling, and flex crack resistance. Some inner layers may be positioned between two layers of a multilayer film to maintain the two layers in position relative to each other and prevent undesirable delamination, i.e. tie layers.

The first and/or second panel of the resealable packages can include pressure sensitive adhesive in an inner layer. As used herein, a "pressure sensitive adhesive" is a bonding agent that is peelable and remains tacky after peeling so that it can be rebonded by manual force. The pressure sensitive adhesive may be co-continuous with the first or second panel or it may be present in a portion of the panel. Necessarily, the pressure sensitive adhesive is present in the reseal flap portion of the second panel or the removable portion of the first panel, or both. The pressure sensitive adhesive layer may be combined with the rest of the panel structure by coextrusion, coating or any other process known to those skilled in the art.

The pressure sensitive adhesive may comprise an elastomeric component and a tackifier component. The elastomeric component may comprise a styrene/rubber copolymer selected from the group consisting of: polystyrene/butadiene/styrene (SBS), polystyrene/isoprene/styrene (SIS), polystyrene/ethylene-butylene/styrene (SEBS), and polystyrene/ethylene-propylene/styrene (SEPS), or blends of any of these materials, and the tackifier component may comprise a terpene resin or a petroleum hydrocarbon resin. In general, the pressure sensitive adhesive may be any pressure sensitive adhesive suitable for providing the functionality as described herein, as would be understood by one of skill in the art.

Figure 16:
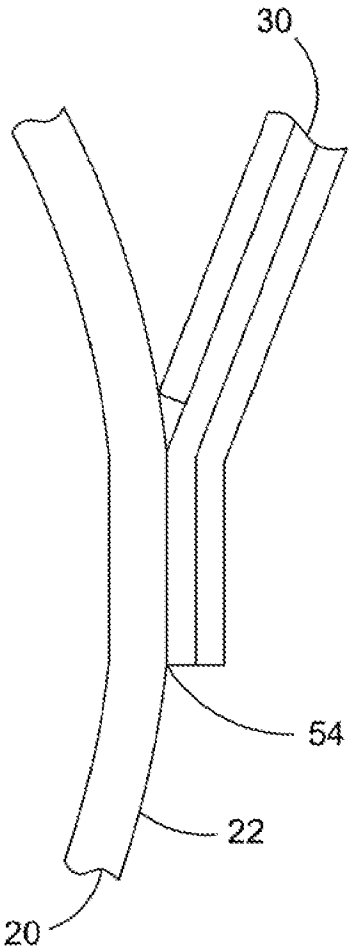
FIG. 16 is an exploded view of the resealed seal area of FIG. 6.
Figure 15:
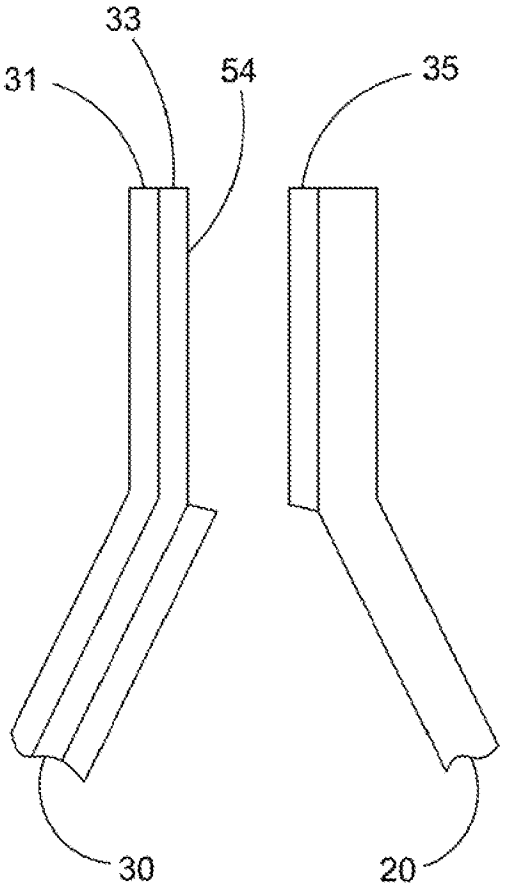
FIG. 15 is an exploded view of the opened seal area of FIG. 4.
Figure 14:
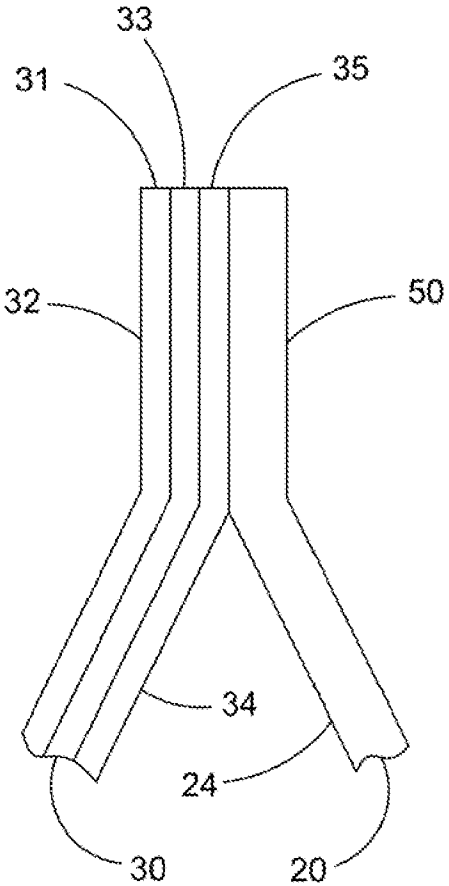
FIG. 14 is an exploded view of the seal area of FIG. 2.

Referring now to FIGS. 14-16, some embodiments of the resealable packages include a pressure sensitive adhesive layer coextruded as an inner layer of the second panel. FIG. 14 is an enlarged view of the top seal area of the closed resealable package, indicated by the dashed circle on FIG. 2. The first and second panels (20 and 30) are bonded at their inner surfaces (24 and 34). As shown in the second panel (30) of FIG. 14, the panels may include an interior layer (35), an inner layer (33) and an exterior layer (31). As used herein, the term "interior layer" refers to the panel layer that is closest to the product containment space or packaged product. As used herein, the term "exterior layer" refers to the panel layer that is furthest removed from the product containment space or packaged product. FIGS. 14-16 are a generalized embodiment of the resealable package and further embodiments could include more layers.

FIG. 15 shows the panels now peeled apart as would occur in the area of the removable portion of the first panel when the package is opened. The interior layer of the second panel (35) is designed to fracture upon experiencing the opening force and peel away from the inner layer (33), the inner layer comprising a pressure sensitive adhesive. After peeling the bonds open and removing the removable portion of the first panel, there is an exposed region of pressure sensitive adhesive (54) remaining on the second panel. The pressure sensitive adhesive (54) is exposed in the bond areas upon peeling open the bond (50). The exposed pressure sensitive adhesive region is then available to be used for reclosing the package. In an alternative embodiment, the pressure sensitive adhesive layer could cohesively fail (i.e. the layer splits) with a portion of the pressure sensitive adhesive on the removable portion of the first panel and a portion of the pressure sensitive adhesive remaining on the second panel.

FIG. 16 depicts the resealable package detail in the resealed state. The reseal flap of the second panel (40, shown in FIGS. 3 and 5) has been folded over the opening and the exposed pressure sensitive adhesive (54) is adhered to the exterior surface of the first panel (22).

FIGS. 14-16 show one embodiment of how the pressure sensitive adhesive can be incorporated into the package. Many other options exist for incorporation of the pressure sensitive adhesive into one or both of the panels. These options include, but are not limited to, incorporating the pressure sensitive adhesive into an inner layer of the first panel, formulating the pressure sensitive adhesive such that it fails in a cohesive manner, pattern applying the pressure sensitive adhesive to portions of the panel (i.e. the pressure sensitive adhesive layer is less than coextensive with the panel) and incorporating the pressure sensitive adhesive in the inner surface of the panels. One of the advantages of the flexible packages described in the present disclosure is that the pressure sensitive adhesive used for resealing the package is incorporated into the panels being used to create the package and no additional components, such as reseal strips, are added.

Another exemplary inner layer comprises a barrier material. As used herein, the term "barrier material" refers to an oxygen and/or water vapor barrier material. Barrier materials used in packaging film include, for example, polyvinyl alcohol copolymers, ethylene vinyl alcohol copolymers, polyvinyl chlorides, polyvinylidene chloride/methyl acrylate copolymers, polyester homopolymers and copolymers, polyolefin homopolymers and copolymers such as polypropylene, polyethylene, preferably, high density polyethylene, metals such as aluminum, zinc, nickel, copper, bronze, gold, silver, tin or alloys thereof, metal oxides, organometallic compounds, ceramics and mixtures thereof. These barrier layers provide protection to packaged goods for freshness. Typically, barrier layers prevent the transmission of light, moisture, oxygen or other gases through the packaging. Barrier layers may also protect other layers from migration from package contents (for example, oils and the like).

Reference throughout this specification to "one embodiment," "certain embodiments," "one or more embodiments" or "an embodiment" means that a particular feature, structure, material, or characteristic described in connection with the embodiment is included in at least one possible embodiment. Thus, the appearances of the phrases such as "in one or more embodiments," "in certain embodiments," "in one embodiment" or "in an embodiment" in various places throughout this specification are not necessarily referring to the same embodiment. Furthermore, the particular features, structures, materials, or characteristics may be combined in any suitable manner in one or more embodiments.

Although the flexible packages disclosed herein have been described with reference to particular embodiments, it is to be understood that these embodiments are merely illustrative of the principles and applications of the present invention. It will be apparent to those skilled in the art that various modifications and variations can be made to the disclosed embodiments without departing from the spirit and scope of the invention. Thus, it is intended that the present invention include modifications and variations that are within the scope of the appended claims and their equivalents.

What is claimed is:

1. A resealable package having a closed state, an open state and a resealed state, wherein the package comprises:

a. a first panel comprising an interior surface, an exterior surface and an edge;

b. a second panel comprising an interior surface and an exterior surface, the second panel positioned generally opposite the first panel;

c. a bond formed between the interior surface of the first panel and the interior surface of the second panel, the bond extending around at least a portion of a periphery of the first and second panels;

d. at least one of either the first and second panels comprising an inner layer comprising a pressure sensitive adhesive, the inner layer fully coextensive with either the first or second panel;

e. a score in the first panel, extending from the edge of the first panel and through the bond, the score defining a removable portion of the first panel; and f. the removable portion of the first panel comprising an unsealed region located between the bond and the edge of the first panel, and adjacent to the score;

wherein the package is configured to transition from the closed state to the open state by fracturing the first panel at the score, peeling the removable portion of the first panel away from the second panel and exposing the pressure sensitive adhesive in the area of the bond; and wherein the package is configured to transition from the open state to the resealed state by folding the second panel to adhere the exposed pressure sensitive adhesive to the exterior surface of the first panel.

2. A resealable package according to claim 1 wherein transitioning from the closed state to the open state further comprises complete separation of the removable portion of the first panel from the package.

3. A resealable package according to claim 1, wherein in the open state the area of exposed pressure sensitive adhesive is irregular.

4. A resealable package according to claim 1 wherein the pressure sensitive adhesive is coextruded with at least one other layer of either the first or second panel.

5. A resealable package according to claim 1 wherein the second panel further comprises a score at least partially located within the bond such that transitioning from the closed state to the open state fractures the score in the second panel removes a portion of the second panel.

6. A resealable package according to claim 5 wherein the score in the second panel has an irregular shape.

7. A resealable package comprising:

a. a first panel comprising an interior surface and an exterior surface;

b. a second panel comprising an interior surface and an exterior surface, the second panel generally opposite the first panel;

c. a bond formed between the interior surface of the first panel and the interior surface of the second panel, the bond extending around at least a portion of a periphery of the panels;

d. a score in the first panel, extending from an edge of the first panel, through the bond, the score defining a removable portion of the first panel;

e. a pressure sensitive adhesive; and f. an unsealed region;

wherein the pressure sensitive adhesive is located as an inner layer of either the first or second panel and the inner layer is fully coextensive with either the first or second panel; and wherein the unsealed region is located on the removable portion of the first panel, adjacent to the score, and between the bond and the edge of the first panel.

8. A resealable package according to claim 7 wherein the score intersects the edge of the first panel in two different locations and the score intersects the bond in two different locations.

9. A resealable package according to claim 7 wherein the first and second panels are continuous with each other.

10. A resealable package according to claim 7 wherein the unsealed region is sized to be grasped with a finger.

11. A resealable package according to claim 7 wherein the package is hermetic.

12. A resealable package according to claim 11 wherein the first and second panels further comprise an oxygen barrier layer.

13. A resealable package according to claim 7 wherein the second panel further comprises a score and a removable portion, wherein the removable portion of the second panel is i. partially coextensive with the removable portion of the first panel, ii. bonded to the removable portion of the first panel, and iii. partially defined by the second panel score.

14. A resealable package having edges, a closed state, an open state, and a resealed state, wherein the package comprises:

a. a first panel having an interior surface and an exterior surface;

b. a second panel positioned generally opposite the first panel having an interior surface and an exterior surface;

c. wherein at least one of the first or second panels is formed from a coextruded multilayer film comprising a layer of pressure sensitive adhesive that is fully coextensive with either panel;

d. a bond affixing the first panel to the second panel, the bond extending around the periphery of the package at the edges;

wherein, in the closed state, the first panel comprises:

i. a score intersecting the bond at two different locations thereof;

ii. a removable portion defined by the area between the score and the edges of the package;

wherein the removable portion comprises a peel tab comprising aligned and unsealed regions of the first and second panels;

wherein the removable portion is configured to separate from the package when transitioning from the closed state to the open state;

wherein, in the open state, the second panel comprises a reseal flap having the pressure sensitive adhesive of the multilayer film on the interior surface of the second panel that is exposed after the removable portion of the first panel is removed from the package when transitioning from the closed state to the open state; and wherein, in the resealed state, the reseal flap is folded over and bonded onto the exterior surface of the first panel.

15. A resealable package according to claim 14, further comprising a product containment space defined by at least the first panel, the second panel and the bond.

16. A resealable package according to claim 15 wherein the package further comprises a tray located in the product containment space.

17. A resealable package according to claim 15 wherein the package further comprises a portionable product located in the product containment space.

18. A resealable package according to claim 14 wherein the bond between the first and second panel is a heat seal.

* * * * *